US006092657A

United States Patent [19]

Hopkins

[11] Patent Number: 6,092,657

[45] Date of Patent: Jul. 25, 2000

[54] BOX SYSTEM FOR SUPPORTING AND DISPLAYING SAND PAPER FROM A ROLL

[76] Inventor: Brian J. Hopkins, 26758 112$^{th}$ Avenue, Maple Ridge, BC, Canada, V2X 8X8

[21] Appl. No.: 09/373,201

[22] Filed: Aug. 12, 1999

[51] Int. Cl.$^{7}$ ..... B65D 85/672

[52] U.S. Cl. ..... 206/397; 206/409

[58] Field of Search ..... 229/39, 53; 206/389, 206/397, 401, 408, 409

[56] References Cited

U.S. PATENT DOCUMENTS

| | | | |
|---|---|---|---|
| 4,947,990 | 8/1990 | Klemets | 206/409 |
| 5,660,313 | 8/1997 | Newbold | 206/409 |

*Primary Examiner*—Jacob K. Ackun

[57] ABSTRACT

A box system for supporting and dispensing sand paper from a roll comprising a generally rectilinear box having upper and lower parallel rectangular faces and front and rear faces and an imperforate interior face and an open exterior face. The front face has a horizontal slot adjacent to the upper face extending inwardly from the open face to a location adjacent to the interior face. A door is provided with a large imperforate wall and small rectangular walls therearound at right angles thereto adapted to cover and close the open exterior face of the box. A hinge couples the box and door for selectively opening and closing the space within the box. A post is fixed within the space with an interior end secured to the interior face of the box for receiving a roll of sandpaper. The sand paper has a free and positionable through the horizontal slot of the box. Lastly provided is a plate with a serrated cutting edge secured to the upper face of the box above the horizontal slot for cutting sand paper extending through the slot.

6 Claims, 2 Drawing Sheets

BOX SYSTEM FOR SUPPORTING AND DISPLAYING SAND PAPER FROM A ROLL

BACKGROUND OF THE INVENTION

1. Field of the Invention

The present invention relates to a box system for supporting and dispensing sand paper from a roll and more particularly pertains to supporting and selectively dispensing sand paper as needed.

2. Description of the Prior Art

The use of dispensers for strip materials of known designs and configurations is known in the prior art. More specifically, dispensers for strip materials of known designs and configurations heretofore devised and utilized for the purpose of supporting and dispensing material through known methods and apparatuses are known to consist basically of familiar, expected, and obvious structural configurations, notwithstanding the myriad of designs encompassed by the crowded prior art which has been developed for the fulfillment of countless objectives and requirements.

By way of example. U.S. Pat. No. 2,073,092 to Avery disclosed a Label and Tape Dispensing Machine. U.S. Pat. No. 4,316,563 to Turner et al. discloses a Container for Dispensing Rolled Product. U.S. Pat. No. 4,416,410 to Herrrmann discloses a Sandpaper Roll Dispenser. U.S. Pat. No. Des. 333,781 to Kobel discloses a Dispensing Carton. U.S. Pat. No. 5,570,809 to Martin discloses an Adhesive Label Dispenser. Lastly, U.S. Pat. No. 5,020,719 to Roth et al. discloses a Dispensing Container.

In this respect, the box system for supporting and dispensing sand paper from a roll according to the present invention substantially departs from the conventional concepts and designs of the prior art, and in doing so provides an apparatus primarily developed for the purpose of supporting and selectively dispensing sand paper as needed.

Therefore, it can be appreciated that there exists a continuing need for a new and improved box system for supporting and dispensing sand paper from a roll which can be used for supporting and selectively dispensing sand paper as needed. In this regard, the present invention substantially fulfills this need.

SUMMARY OF THE INVENTION

In view of the foregoing disadvantages inherent in the known types of dispensers for strip materials of known designs and configurations now present in the prior art, the present invention provides an improved body system for supporting and dispensing sand paper from a roll. As such, the general purpose of the present invention, which will be described subsequently in greater detail, is to provide a new and improved box system for supporting and dispensing sand paper from a roll and method which has all the advantages of the prior art and none of the disadvantages.

To attain this, the present invention essentially comprises a new and improved body system for supporting and dispensing sand paper from a roll for supporting and selectively dispensing sand paper as needed comprises, in combination a generally rectilinear box having upper and lower parallel rectangular faces and front and rear faces and an imperforate interior face and an open exterior face. The front face has a horizontal slot adjacent to the upper face extending inwardly from the open face to a location adjacent to the interior face. The front face also has a vertical slot in proximity to the open exterior face. A door is provided with a large imperforate wall and small rectangular walls therearound and at right angles thereto adapted to cover and close the open exterior face of the box. Also provided is a hinge for coupling the box and door for selectively opening and closing the space within the box. Additionally provided is a closure tang secured to one face of the door remote from the hinge for interfacing with the vertical slot to selectively lock the door and close the space within the box. A fixed ost is fixed within the space within the box and has an interior end secured to the interior face of the box with a hollow sleeve rotatably secured over the post for receiving a roll of sand paper. The sand paper has a free end positionable through the horizontal slot of the box for dispensing purposes. A plate is provided with a serrate cutting edge secured to the upper face of the box above the horizontal slot for cutting sand paper extending through the slot. Lastly provided is a clip secured to the interior face of the box to selectively coupled the box to a user.

There has thus been outlined, rather broadly, the more important features of the invention in order that the detailed description thereof that follows may be butter understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of the other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved box system for supporting and dispensing sand paper from a roll which has all of the advantages of the prior art dispensers for strip materials of known designs and configurations and none of the disadvantages.

It is another object of the present invention to provide a new and improved body system for supporting and dispensing sand paper from a roll which may be easily and efficiently manufactured and marketed.

It is further object of the present invention to provide a new and improved box system for supporting and dispensing sand paper from a roll which is of durable and reliable constructions.

An even further object of the present invention is to provide a new and improved box system for supporting and dispensing sand paper from a roll which is susceptible of a low cost of manufacture with regard to both materials and labor, and which accordingly is then susceptible of low prices of sale to the consuming public, thereby making such box system for supporting and dispensing sand paper from a roll economically available to the buying public.

Even still another object of the present invention is to provide a box system for supporting and dispensing sand paper from a roll for supporting and selectively dispensing sand paper as needed.

Lastly, it is an object of the present invention to provide a new and improved box system for supporting and dispensing sand paper from a roll comprising a generally rectilinear box having upper and lower parallel rectangular faces and front and rear faces and an imperforate interior face and an open exterior face. The front face has a horizontal slot adjacent to the upper face extending inwardly from the open face to a location adjacent to the interior face. A door is provided with a larger imperforate wall and small rectangular walls therearound at right angles thereto adapted to cover and close the open exterior face of the box. A hinge couples the box and door for selectively opening and closing the space within the box. A post is fixed within the space with an interior end secured to the interior face of the box for receiving a roll of sandpaper. The sand paper has a free end positionable through the horizontal slot of the box. Lastly provided is a plate with a serrated cutting edge secured to the upper face of the box above the horizontal slot for cutting sand paper extending through the slot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be has to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
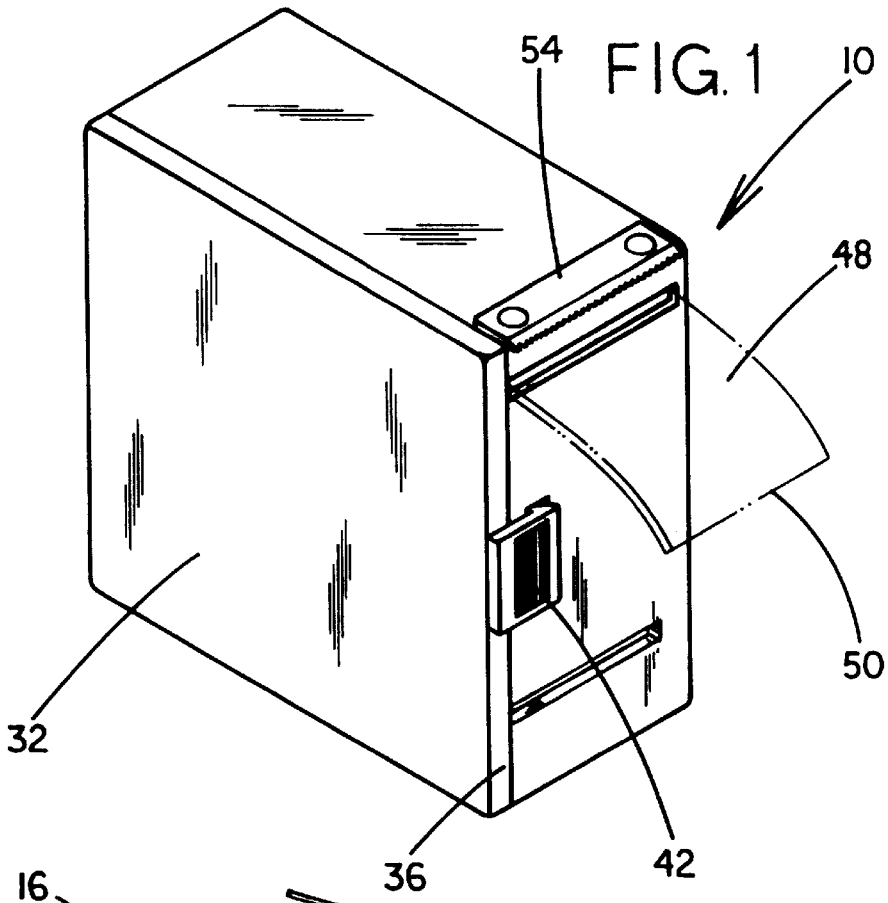
FIG. 1 is a perspective view of the preferred embodiment of the box system for supporting and dispensing sand paper from a roll constructed in accordance with the principles of the present invention.
Figure 2:
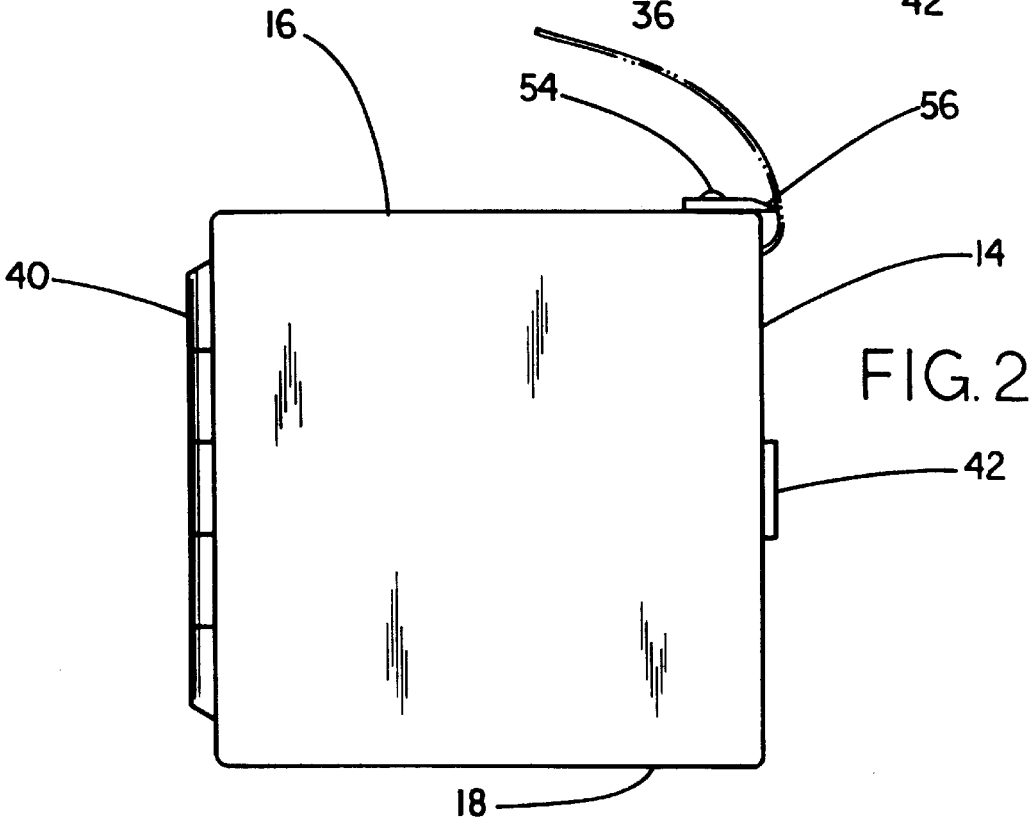
FIG. 2 is a side elevational view of the box as shown in FIG. 1.

With reference now to the drawings, and in particular to FIG. 1 thereof, the preferred embodiment of the new and improved box system for supporting and dispensing sand paper from a roll embodying the principles and concepts of the present invention and generally designated by the reference numberal 10 will be described.

The present invention, the box system for supporting and dispensing sand paper from a roll 10 is comprised of a plurality of components. Such components are individually configured and correlated with respect to each other so as to attain the desired objective.

More specifically, the new and improved box system for supporting and dispensing sand paper from a roll for supporting and selectively dispensing sand paper as needed comprises, in combination a generally rectilinear body 14 having upper and lower parallel rectangular faces 16, 18 and front and rear faces 20, 22 and an imperforate interior face 24 and an open exterior face 26. The front face has a horizontal slot 28 adjacent to the upper face extending inwardly from the open face to a location adjacent to the interior face. The front face also has a vertical slot 30 in proximity to the open exterior face. A door 32 is provided with a large imperforate wall 34 and small rectangular walls 36 therearound and at right angles thereto adapted to cover and close the open exterior face of the box. Also provided is a hinge 40 for coupling the box and door for selectively opening and closing the space within the box.

Additionally provided is a closure tang 42 secured to one of the small rectangular walls of the door remote from the hinge for interfacing with the vertical slot to selectively engage the vertical slot 30 for locking the door and closing the space within the box. The tang preferably includes a plate with a triangular outboard edge and an undulated outer surface.

A fixed post 44 is fixed within the space within the box and has an interior end secured to a central extent of the interior face of the box with a hollow sleeve 46 rotatably secured over the post for receiving a roll of sand paper 48. The sand paper has a free end 50 positionable through the horizontal slot of the box for dispensing purposes. As an option, the post may be free floating or rotatably coupled to the box.

A plate 54 is provided with a serrated cutting edge 56 secured to the upper face of the box above the horizontal slot for cutting sand paper extending through the slot. The serrated cutting edge preferably remains spaced from and in parallel with the horizontal slot during use. Lastly provided is a clip 60 secured to the interior face of the box to selectively couple the box to a user. The clip preferably has an inverted U-shaped configuration and a lower out-turned lip.

Figure 3:
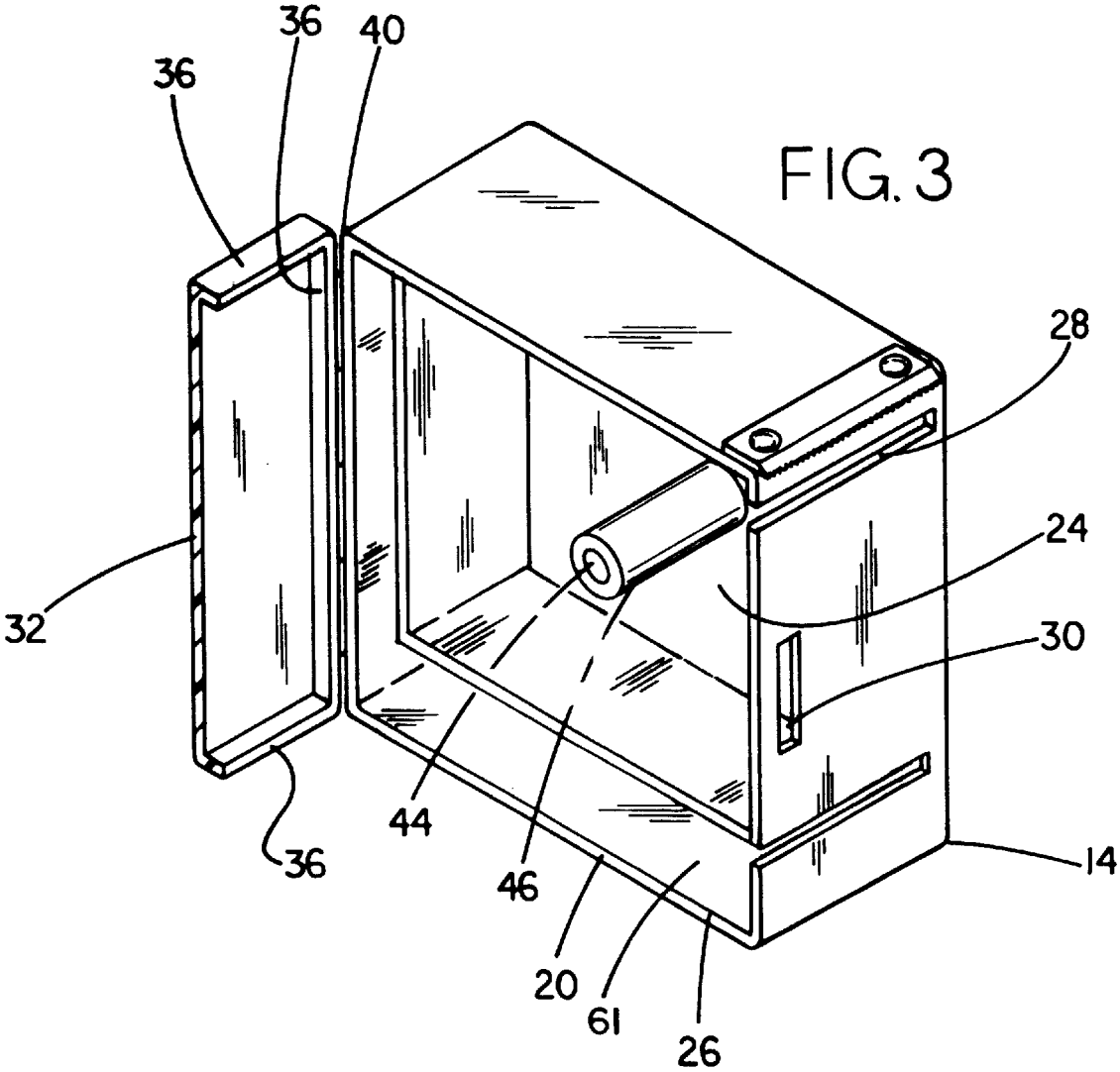
FIG. 3 is a perspective view similar to FIG. 1 but showing the box in an open configuration.
Figure 4:
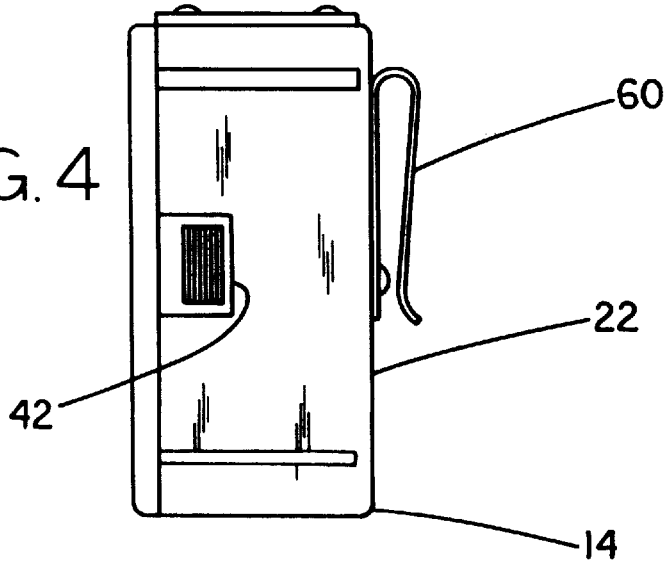
FIG. 4 is a front elevational view of the box shown in the prior Figure.

As shown in FIG. 3, an optional compartment 61 may line the lower and rear faces of the box. Such compartment is defined by auxiliary lower and rear faces which are slightly spaced from and parallel with the lower and rear faces of the box. Situated along a lower end of the from face is a second horizontal slot which remains in communication with the optional compartment. In operation, the optional compartment may be employed to contain used pieced of sand paper for later reuse. In yet another alternate embodiment, a clip similar to the one set forth hereinabove may be mounted on the door of the box and used to secure the used pieced of sand paper.

As described hereinabove, the system of the present invention is a small, square, plastic box that contains, organizes and dispenses rolls of sanding cloth.

The spool of the sanding cloth is mounted to a post protruding from the center of the back plate of this device. Positioning the roll over the post allows it to rotate as the sanding cloth is pulled as needed.

The sanding cloth is pulled through a slot positioned underneath the seam that connects the right side and top of the box. After the appropriate length is pulled, the tape is torn across a jagged cutting blade positioned directly above the slot. The front face of the box is hinged so that once the roll is empty, it is easily replaced. This hinged face is than closed to seal the box.

The appealing features of the system are its convenience, ease of use, lightweight, durability, organization, protection of the work material, efficiency, and timesaving qualities. Commercial/professional workers such as trades people, welders, and auto body repairers can easily utilize the system to simplify the task of using and dispensing sand cloth.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved box system for supporting and dispensing sand paper from a roll for supporting and selectively dispensing sand paper as needed comprising, in combination:

a generally rectilinear box having upper and lower parallel rectangular faces and front and rear faces and an imperforate interior face and an open exterior face, the front face having a horizontal slot adjacent to the upper face extending inwardly from the open face to a location adjacent to the interior face, the from face also having a vertical slot in proximity to the open exterior face;

a door having a large imperforate wall and small rectangular walls therearound and at right angles thereto adapted to cover and close the open exterior face of the box;

a hinge coupling the box and door for selectively opening and closing the space within the box;

a closure tang secured to one face of the door remote from the hinge for interfacing with the vertical slot to selectively lock the door and close the space within the box; a fixed post within the space within the box and having an interior end secured to the interior face of the box with a hollow sleeve rotatably secured over the post for receiving a roll of sand paper, the sand paper having a free end positionable through the horizontal slot of the box for dispensing purposes;

a plate with a serrated cutting edge secured to the upper face of the box above the horizontal slot for cutting sand paper extending through the slot;

a clip secured to the interior face of the box to selectively couple the box to a user; and means for containing a plurality of pieces of used sand paper.

2. A box system for supporting sand paper and dispensing the same from a roll comprising:

a roll of sand paper;

a box with an openable door and a slot;

a post mounted within the box for rotatably mounting the roll of sand paper thereon and dispensing the same from the slot; and a serrated cutting edge situated on the box for cutting sand paper extending through the slot.

3. The system as set forth in claim 2 wherein the door covers an opening of the box which resides opposite a wall on which the post is coupled.

4. The system as set forth in claim 2 wherein the door is hingably and snappily secured to the box.

5. The system as set forth in claim 2 and further including a holder for holding used pieces of sand paper.

6. The system as set forth in claim 2 and further including means for holding used pieces of sand paper.

* * * * *